US009648992B2

(12) United States Patent
Harris et al.

(10) Patent No.: US 9,648,992 B2
(45) Date of Patent: May 16, 2017

(54) PUMPS WITH VENTS TO VENT INVERTED CONTAINERS AND REFILL UNITS HAVING NON-COLLAPSING CONTAINERS

(71) Applicant: GOJO Industries, Inc., Akron, OH (US)

(72) Inventors: Donald R. Harris, Tallmadge, OH (US); Aaron D. Marshall, Uniontown, OH (US); John J. McNulty, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 42 days.

(21) Appl. No.: 14/549,788

(22) Filed: Nov. 21, 2014

(65) Prior Publication Data

US 2015/0173568 A1 Jun. 25, 2015

Related U.S. Application Data

(60) Provisional application No. 61/918,504, filed on Dec. 19, 2013.

(51) Int. Cl.
*B67D 7/76* (2010.01)
*A47K 5/14* (2006.01)
(Continued)

(52) U.S. Cl.
CPC ..... *A47K 5/14* (2013.01); *A47K 5/1211* (2013.01); *B05B 7/0025* (2013.01);
(Continued)

(58) Field of Classification Search
CPC ..... A47K 5/14; A47K 5/1211; B05B 7/0025; B05B 11/0018; B05B 11/3087; B05B 11/3047; B05B 11/3069
(Continued)

(56) References Cited

U.S. PATENT DOCUMENTS 585,327 A 6/1897 Guttenberg
922,453 A 5/1909 Burgner
(Continued)

FOREIGN PATENT DOCUMENTS

CH 676227 12/1990
DE 102008034244 3/2010
(Continued)

OTHER PUBLICATIONS

Office Action from U.S. Appl. No. 14/327,975 dated May 7, 2015.
(Continued)

*Primary Examiner* — Kevin P Shaver
*Assistant Examiner* — Michael J Melaragno
(74) *Attorney, Agent, or Firm* — Calfee, Halter & Griswold LLP

(57) ABSTRACT

Exemplary embodiments of refill units having foam pumps and non-collapsing containers are disclosed herein. In some exemplary embodiments, the refill unit includes a non-collapsing container and a foam pump. The foam pump includes a compressible air chamber. The foam pump includes a passage between the interior of the compressible air chamber and the interior of the container. A regulating valve regulates flow of air from the interior of the compressible air chamber to the interior of the container.

19 Claims, 2 Drawing Sheets

(51) Int. Cl.
*A47K 5/12* (2006.01)
*B05B 11/00* (2006.01)
*B05B 7/00* (2006.01)

(52) U.S. Cl.
CPC ..... *B05B 11/0018* (2013.01); *B05B 11/3087* (2013.01); *B05B 11/3047* (2013.01); *B05B 11/3069* (2013.01)

(58) Field of Classification Search
USPC ..... 222/190
See application file for complete search history.

(56) References Cited

U.S. PATENT DOCUMENTS 1,167,420 A 1/1916 Marcuse
1,207,278 A 12/1916 Cordley
1,207,505 A 12/1916 Cordley
1,220,753 A 3/1917 Kees
1,303,708 A 5/1919 Moffitt
1,553,113 A 9/1935 Amos
2,464,030 A 3/1949 Engstrom
2,529,365 A 11/1950 Barksdale
2,605,021 A 7/1952 Spencer et al.
2,746,651 A * 5/1956 Lewis ..... B65D 47/063 222/213
2,770,234 A 11/1956 Nesset et al.
2,851,201 A * 9/1958 Poitras ..... A61J 1/1406 215/DIG. 3
2,904,222 A 9/1959 Philippe
3,200,994 A 8/1965 Levinson et al.
3,215,319 A 11/1965 Laker
3,239,151 A 3/1966 Boris-Nee Jokelson
3,361,078 A 1/1968 Cooprider
3,628,704 A 12/1971 Corsette
3,674,181 A 7/1972 Marks et al.
3,790,034 A 2/1974 Horvath
3,851,801 A 12/1974 Roth
4,057,176 A 11/1977 Horvath
4,142,653 A 3/1979 Mascla et al.
4,168,020 A 9/1979 Benson
4,183,449 A 1/1980 Blake
4,249,676 A 2/1981 Beery
4,272,019 A 6/1981 Halaby, Jr.
4,321,938 A 3/1982 Siller
4,330,071 A 5/1982 Ohlson
4,360,130 A 11/1982 Nishimura et al.
4,410,107 A 10/1983 Corsette
4,493,440 A 1/1985 von Buelow et al.
4,597,511 A * 7/1986 Licari ..... B05B 11/3067 137/454.6
4,646,945 A 3/1987 Steiner
4,694,976 A 9/1987 Schuetz
4,793,522 A 12/1988 Corsette
4,798,311 A 1/1989 Workum
4,880,161 A 11/1989 Wright
4,930,667 A 6/1990 Holzner, Sr.
4,932,561 A 6/1990 Boxall
4,986,453 A 1/1991 Lina et al.
4,997,429 A 3/1991 Dickerhoff et al.
5,033,654 A 7/1991 Bennett
5,037,006 A 8/1991 Kock
5,082,150 A 1/1992 Steiner
5,110,052 A 5/1992 Graf et al.
5,238,187 A 8/1993 Zlotnik et al.
5,271,530 A 12/1993 Uehira et al.
5,282,552 A 2/1994 Ophardt
5,310,094 A 5/1994 Martinez et al.
5,398,845 A * 3/1995 Meyer ..... A45D 27/10 222/1
5,439,140 A 8/1995 Meyer
5,443,569 A 8/1995 Uehira et al.
5,445,288 A 8/1995 Banks
5,462,208 A 10/1995 Stahley et al.
5,489,044 A 2/1996 Ophardt
5,503,306 A 4/1996 Knickerbocker
5,507,417 A 4/1996 Webb
5,544,788 A * 8/1996 Meyer ..... B67D 99/00 222/110
5,549,224 A 8/1996 Wu
5,664,703 A * 9/1997 Reifenberger ..... B05B 11/0016 222/207
5,676,277 A * 10/1997 Ophardt ..... A47K 5/1205 222/181.1
5,727,715 A 3/1998 McKenna
5,752,627 A 5/1998 Vandromme
5,826,755 A 10/1998 Burd
5,862,954 A 1/1999 Ehrensperger
5,899,363 A 5/1999 Bliss, III et al.
5,906,299 A 5/1999 Hagleitner
5,927,559 A 7/1999 Bommer et al.
6,016,936 A 1/2000 Fan
6,053,364 A 4/2000 van der Heijden
6,065,647 A 5/2000 Bliss, III et al.
6,082,586 A 7/2000 Banks
6,244,472 B1 6/2001 Hennermann
6,378,742 B1 4/2002 Rohr et al.
6,386,403 B2 5/2002 Parsons et al.
6,446,840 B2 9/2002 Ophardt et al.
6,540,111 B2 4/2003 Sunnarorg
6,644,516 B1 * 11/2003 Foster ..... B05B 7/0031 222/190
6,669,060 B2 12/2003 DeLaforcade
6,688,499 B2 2/2004 Zhang
6,921,004 B1 7/2005 Knickerbocker
6,971,549 B2 12/2005 Leifheit et al.
6,986,443 B2 1/2006 Laible
7,004,356 B1 * 2/2006 Sayers ..... B05B 7/0037 222/137
7,021,494 B2 4/2006 Mazooji et al.
7,040,511 B1 5/2006 Petit
7,048,136 B2 * 5/2006 Havens ..... B65D 51/1644 206/524.8
7,059,282 B2 6/2006 Vorih et al.
7,303,098 B2 12/2007 Backes
7,308,990 B2 12/2007 Mazooji et al.
7,337,930 B2 3/2008 Ophardt et al.
7,377,758 B2 5/2008 Sallows et al.
7,461,762 B2 12/2008 Law et al.
7,543,722 B2 * 6/2009 Yates ..... A47K 5/14 222/135
7,641,007 B2 1/2010 Radke et al.
7,708,166 B2 5/2010 Ophardt
7,735,692 B2 * 6/2010 Nelson ..... B05B 11/3087 222/153.13
7,806,301 B1 10/2010 Ciavarella et al.
7,815,076 B2 10/2010 Ophardt
7,928,297 B1 4/2011 Thompson
8,002,150 B2 8/2011 Ophardt et al.
8,047,403 B2 11/2011 Quinlan et al.
8,047,404 B2 11/2011 Quinlan et al.
8,272,539 B2 9/2012 Ophardt et al.
8,474,664 B2 7/2013 Ophardt et al.
8,523,024 B2 9/2013 Piscopo et al.
8,579,159 B2 11/2013 Ciavarella
8,596,501 B2 12/2013 Hagleitner
8,602,263 B2 12/2013 Baron et al.
8,662,356 B2 3/2014 Padain et al.
8,733,588 B2 5/2014 Ophardt et al.
8,875,952 B2 * 11/2014 Ciavarella ..... B05B 7/0025 222/145.5
2002/0000450 A1 * 1/2002 Brown ..... B05C 17/003 222/137
2002/0153389 A1 10/2002 Creaghan et al.
2002/0179735 A1 12/2002 Santaguilina
2003/0000967 A1 1/2003 Ehrensperger
2004/0031816 A1 2/2004 Schuman
2005/0072805 A1 4/2005 Matthews
2005/0109798 A1 5/2005 Kasting
2005/0205600 A1 9/2005 Ophardt et al.
2005/0284887 A1 12/2005 Lewis et al.
2006/0032871 A1 2/2006 Ophardt
2006/0076364 A1 4/2006 Stark

(56) References Cited

U.S. PATENT DOCUMENTS

2006/0175354 A1* 8/2006 Ophardt ..... A47K 5/1202 222/188
2006/0273114 A1 12/2006 Ophardt
2006/0278657 A1 12/2006 Roatis
2007/0023454 A1 2/2007 Ophardt
2007/0158367 A1* 7/2007 Lin ..... B05B 11/3015 222/321.7
2007/0172369 A1* 7/2007 Boermann ..... A47K 5/1207 417/488
2007/0215643 A1* 9/2007 Law ..... B05B 7/0025 222/190
2007/0257064 A1* 11/2007 Ophardt ..... B05B 11/3001 222/251
2008/0035223 A1 2/2008 Ritsche
2008/0141635 A1 6/2008 Clerget
2008/0149666 A1 6/2008 Lafamme et al.
2008/0272148 A1 11/2008 Malik et al.
2008/0314931 A1* 12/2008 van der Heijden ... B05B 7/0025 222/190
2009/0001100 A1 1/2009 van der Heijden
2009/0184134 A1* 7/2009 Ciavarella ..... A47K 5/14 222/135
2009/0188944 A1 7/2009 Ciavarella et al.
2009/0200337 A1* 8/2009 Quinlan ..... A47K 5/14 222/190
2009/0200338 A1 8/2009 Quinlan et al.
2009/0308894 A1 12/2009 Ophardt et al.
2009/0314806 A1* 12/2009 Ray ..... A47K 5/1207 222/190
2010/0096412 A1 4/2010 Law
2010/0213220 A1* 8/2010 Laible ..... B67D 7/0294 222/481.5
2011/0014076 A1 1/2011 Shi et al.
2011/0031278 A1 2/2011 Hande Man
2011/0079614 A1 4/2011 Ganzeboon et al.
2011/0089198 A1 4/2011 Leuliet
2011/0139825 A1 6/2011 Houghton
2011/0174840 A1 7/2011 Law et al.
2012/0067923 A1 3/2012 Matthews et al.
2012/0074171 A1 3/2012 Quinlan
2012/0111891 A1* 5/2012 McNulty ..... A47K 5/1208 222/181.3
2012/0160879 A1* 6/2012 Ciavarella ..... A47K 5/14 222/409
2012/0285992 A1* 11/2012 Ciavarella ..... F04C 13/00 222/138
2013/0015209 A1* 1/2013 Smith ..... A47K 5/1208 222/207
2013/0037573 A1* 2/2013 Spiegelberg ..... A47K 5/14 222/190
2013/0037575 A1* 2/2013 van der Molen ..... B05B 1/3436 222/207
2013/0043280 A1* 2/2013 Hagleitner ..... A47K 5/1208 222/207
2013/0056497 A1* 3/2013 McNulty ..... A47K 5/1215 222/190
2013/0094983 A1* 4/2013 Pelfrey ..... A47K 5/14 417/472
2013/0119083 A1* 5/2013 Ophardt ..... A47K 5/1204 222/64
2013/0140380 A1* 6/2013 Pelfrey ..... A47K 5/14 239/311
2013/0206794 A1* 8/2013 McNulty ..... A47K 5/1202 222/136
2013/0299517 A1* 11/2013 Ciavarella ..... B05B 7/0037 222/190
2013/0299518 A1* 11/2013 McNulty ..... A47K 5/14 222/190
2013/0315031 A1 11/2013 Bunoz et al.
2013/0320043 A1* 12/2013 McNulty ..... B67D 7/64 222/380
2014/0034679 A1 2/2014 Fitzpatrick
2014/0054320 A1* 2/2014 Harris ..... A47K 5/14 222/153.09
2014/0054322 A1* 2/2014 McNulty ..... A47K 5/14 222/190
2014/0054323 A1* 2/2014 McNulty ..... A47K 5/14 222/190
2014/0061245 A1 3/2014 McNulty et al.
2014/0061246 A1* 3/2014 McNulty ..... A47K 5/14 222/190
2014/0117053 A1* 5/2014 Ciavarella ..... F04B 53/14 222/190
2014/0203047 A1 7/2014 McNulty
2014/0205473 A1* 7/2014 Ciavarella ..... B65D 83/00 417/313
2014/0231462 A1* 8/2014 Ray ..... A47K 5/1202 222/207
2014/0263462 A1* 9/2014 Quinlan ..... B05B 11/3097 222/190
2014/0319180 A1* 10/2014 Quinlan ..... A47K 5/16 222/190
2014/0367419 A1* 12/2014 Harris ..... A47K 5/14 222/190
2015/0196170 A1* 7/2015 Harris ..... A47K 5/1211 222/190
2015/0208877 A1* 7/2015 Harris ..... A47K 5/1211 222/383.1
2015/0239644 A1* 8/2015 Wells ..... B65D 83/16 222/325
2015/0251842 A1* 9/2015 Rymer ..... A61D 7/00 222/401
2015/0297039 A1* 10/2015 Harris ..... B05B 7/0018 222/136
2015/0335208 A1* 11/2015 Ciavarella ..... A47K 5/1211 222/65
2015/0342421 A1* 12/2015 Harris ..... A47K 5/14 222/190
2016/0029855 A1* 2/2016 Harris ..... A47K 5/14 222/135

FOREIGN PATENT DOCUMENTS

DE 102011107376 1/2013
EP 0613728 A2 1/1994
EP 1147818 10/2001
EP 2080464 7/2009
EP 2080560 7/2009
FR 2199588 4/1974
GB 1269545 4/1972
GB 2301812 12/1996
GB 2472235 2/2011
WO 98/18563 A1 5/1998
WO 2006075196 A1 7/2006
WO 2011157975 12/2011

OTHER PUBLICATIONS

European Patent Office Search Report issued Jan. 7, 2011 in EP Application No. 09 150 882.2; 4 pages.
International Search Report and Written Opinion from International Application No. PCT/US2014/067030 date of mailing Feb. 4, 2015.
International Search Report and Written Opinion from International Application No. PCT/US2014/055065 date of mailing Dec. 12, 2014.
Office Action from U.S. Appl. No. 14/628,478 dated Jan. 20, 2016.
Office Action from U.S. Appl. No. 14/484,328 dated Feb. 1, 2016.
Office Action from U.S. Appl. No. 14/327,975 dated Feb. 12, 2016.

* cited by examiner

PUMPS WITH VENTS TO VENT INVERTED CONTAINERS AND REFILL UNITS HAVING NON-COLLAPSING CONTAINERS

RELATED APPLICATIONS

This application claims priority to and the benefits of U.S. Provisional Patent Application Ser. No. 61/918,504 filed on Dec. 19, 2013 and entitled "PUMPS WITH VENTS TO VENT INVERTED CONTAINERS AND REFILL UNITS HAVING NON-COLLAPSING CONTAINERS," which is incorporated herein by reference in its entirety.

TECHNICAL FIELD

The present invention relates generally to liquid dispenser systems and more particularly to air-vented liquid dispensers, as well as refill units for use with such dispensers.

BACKGROUND OF THE INVENTION

Liquid dispenser systems, such as liquid soap and sanitizer dispensers, provide a user with an amount of liquid upon actuation of the dispenser. It is desirable to provide such a dispenser having a rigid container that is vented with air so that the pump may re-prime itself after a dispensing action. It is also desirable to provide such a dispenser that is easily recharged once the container runs out of liquid to dispense, and that is inexpensive to produce.

SUMMARY

Exemplary embodiments of refill units having foam pumps and non-collapsing containers are disclosed herein. In some exemplary embodiments, the refill unit includes a non-collapsing container and a foam pump. The foam pump includes a compressible air chamber. The foam pump includes a passage between the interior of the compressible air chamber and the interior of the container. A regulating valve regulates flow of air from the interior of the compressible air chamber to the interior of the container.

Another exemplary embodiment of a refill unit includes a non-collapsing container and a foam pump. The foam pump includes a compressible air chamber and an air passage between the interior of the compressible air chamber and an interior of the container. A moveable valve secured to the passage. The movable valve has a first position that prevents pressurized air from flowing from the air chamber into the interior of the container and a second position that allows vacuum pressure in the interior of the container to draw air from the interior of the compressible air chamber to the interior of the container.

Another exemplary refill unit includes a non-collapsing container and a foam pump. The foam pump has a compressible air chamber and a passage between the interior of the compressible air chamber and an interior of the container. The foam pump includes a valve secured to the passage. The valve has a wiper seal located within the interior of the container and a second seal located at least partially within the compressible air chamber.

In this way, a simple and economical refill unit with a container vent located between the air pump chamber and the container are provided.

BRIEF DESCRIPTION OF THE DRAWINGS

These and other features and advantages of the present invention will become better understood with regard to the following description and accompanying drawings in which.

DETAILED DESCRIPTION

Figure 1:
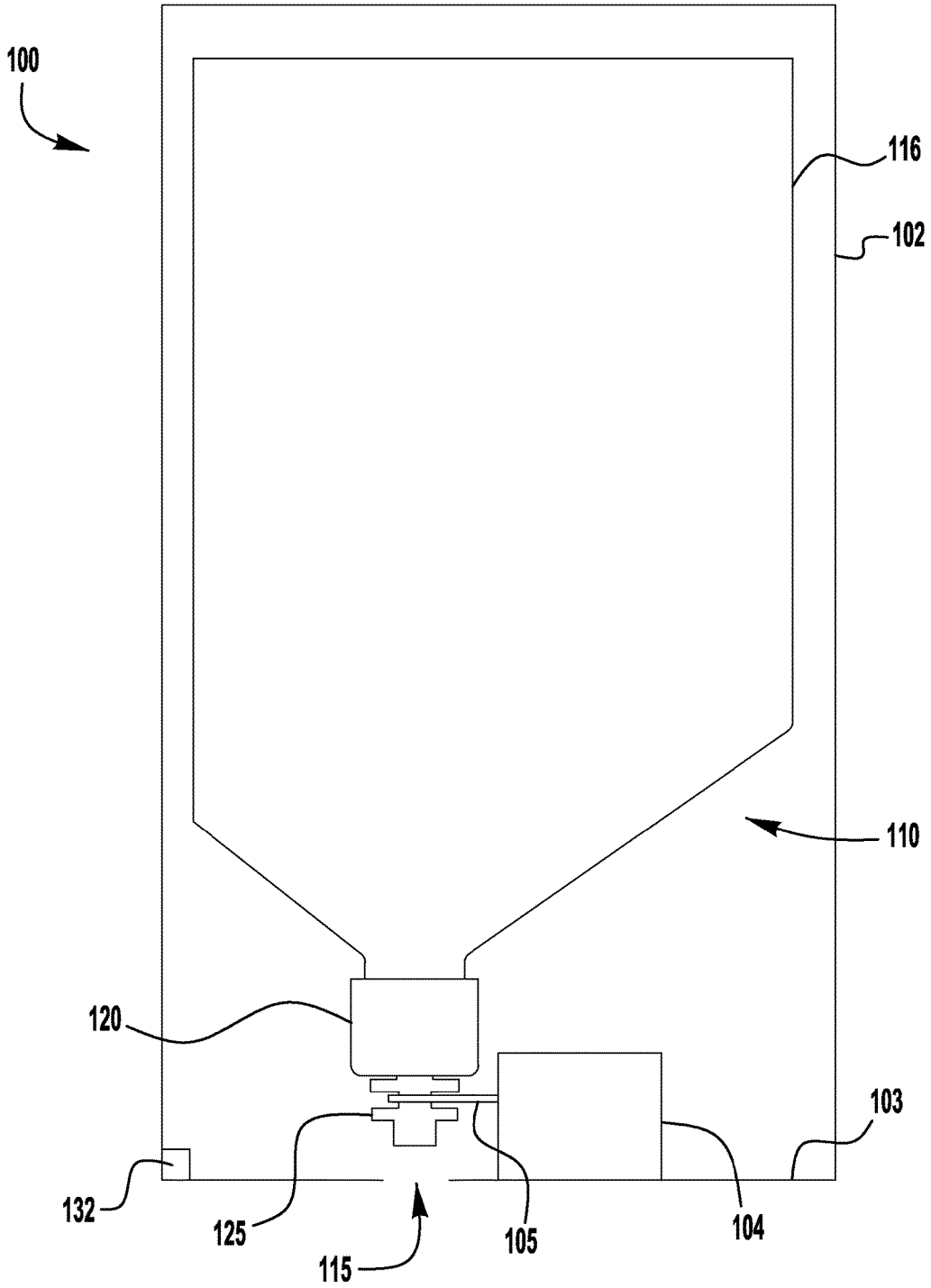
FIG. 1 is a cross-section of an exemplary liquid dispenser having a refill unit with a pull pump.

FIG. 1 illustrates an exemplary embodiment of a dispenser 100. The cross-section of FIG. 1 is taken through the housing 102 to show the pump 120 and container 116. Dispenser 100 includes a disposable refill unit 110. The disposable refill unit 110 includes a container 116 connected to pump 120. The dispenser 100 may be a wall-mounted system, a counter-mounted system, an un-mounted portable system movable from place to place or any other kind of liquid dispenser system. Dispenser 100 is a foam dispenser.

The container 116 forms a liquid reservoir that contains a supply of foamable liquid within the disposable refill unit 110. In various embodiments, the contained liquid could be, for example, a soap, a sanitizer, a cleanser, a disinfectant. In the exemplary disposable refill unit 110, the container 116 is a non-collapsible container and can be made of thin plastic or like material. The container 116 may advantageously be refillable, replaceable or both refillable and replaceable.

In the event the liquid stored in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air or foam. Actuator 104 is generically illustrated because there are many different kinds of pump actuators which may be employed in the foam dispenser 100. The actuator 104 of the foam dispenser 100 may be any type of actuator such as, for example, a manual lever, a manual pull bar, a manual push bar, a manual rotatable crank, an electrically activated actuator or other means for actuating the pump 120. Electronic actuators may additionally include a sensor 132 for detecting the presence of an object and to provide for a hands-free dispenser system with touchless operation. Various intermediate linkages, such as for example linkage 105, connect the actuator member 104 to the pump 120 within the system housing 102. An aperture 115 is located in bottom plate 103 of housing 102 and allows liquid dispensed from the nozzle 125 of pump 120 to be dispensed to a user.

Figure 2:
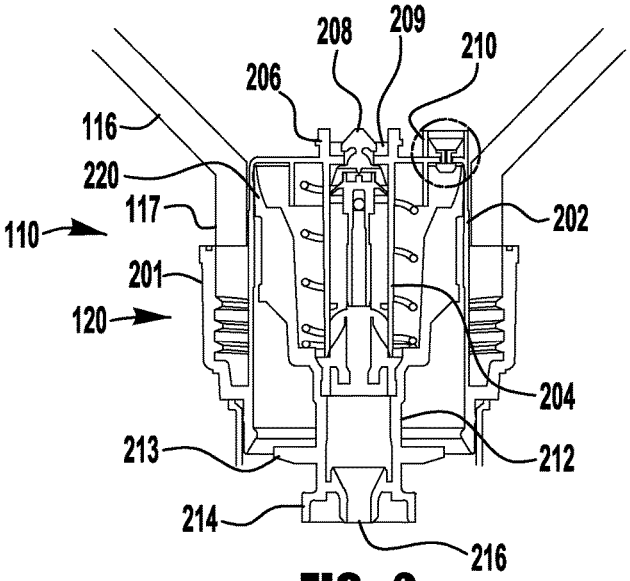
FIGS. 2 and 3 are partial cross-sections of the exemplary refill unit.
Figure 3:
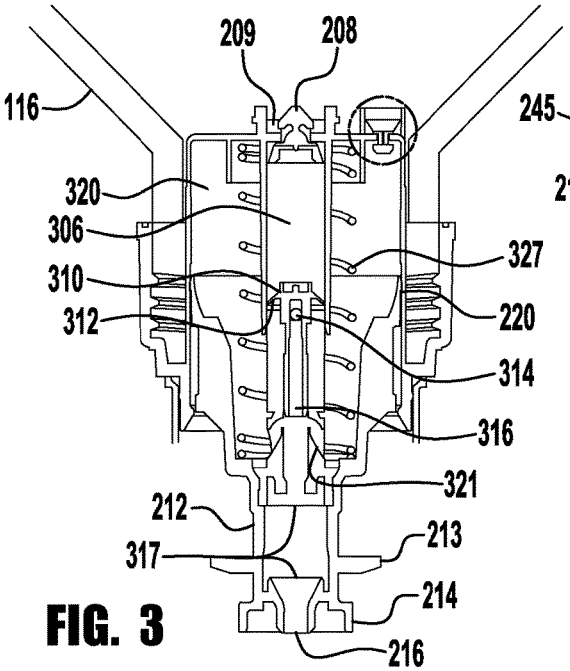

FIGS. 2 and 3 are partial cross-sections of an exemplary embodiment of refill unit 110. Foam pump 120 includes a collar 201 that connects to the neck 117 of container 116. Collar 201 may connect to neck 117 of container 116 in any manner such as for example a threaded connection.

Foam pump 120 includes a housing 202 that fits at least partially within neck 117. Foam pump 120 includes an inner cylindrical housing 204. In addition, housing 202 includes an first annular projection 206 and an aperture 209. Aperture 209 extends from inside the container 116 into liquid pump chamber 306. A liquid inlet valve 208 is located within aperture 209. Liquid inlet valve 208 is a one-way valve that allows liquid to flow from the container 116 into liquid pump chamber 306. Liquid inlet valve 208 may be any type of one-way valve, such as for example, a wiper valve, ball and spring valve, an umbrella valve, a flapper valve or the like.

Figure 2A:
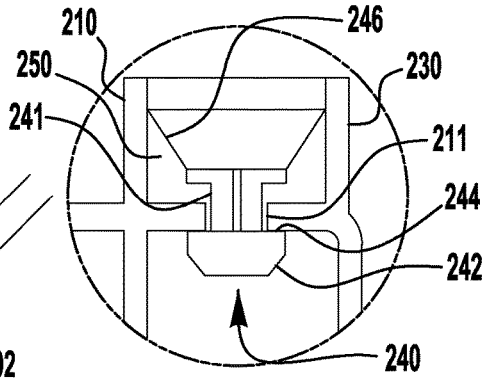
FIGS. 2A and 3A are enlarged cross sections of an exemplary venting valve of the exemplary embodiment of the refill unit.
Figure 3A:
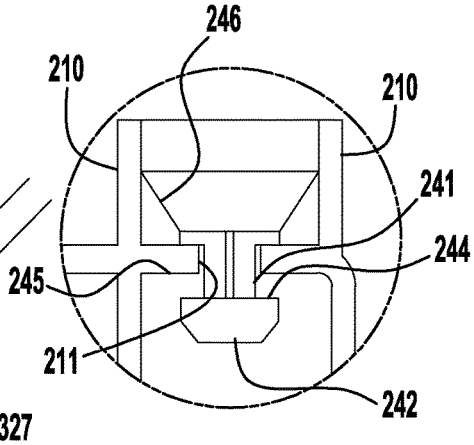

Cylindrical pump housing 202 includes a second annular projection 210. Located within annular projection 210 is an aperture 211. Aperture 211 extends between the inside of the container 116 and air pump chamber 320 of foam pump 120. A venting valve 240 or regulating valve is located at least partially within aperture 211. As can be more clearly seen in FIG. 2A and FIG. 3A, venting valve 240 includes an elongated body 241 with a head 242 on a first side. Head 242 includes a sealing surface 244. On the second side of elongated body 211 is a wiper seal 246. Wiper seal 246 engages the inner wall of annular projection 210. Venting valve 240 moves freely up and down in aperture 211 and there is a gap between elongated member 241 and the walls of aperture 211 to allow air to flow past elongated body 241.

Foam pump 120 includes a piston 212. Piston 212 has a first engagement member 213 and a second engagement member 214. First engagement member 213 and second engagement member 214 engages an actuator 104 (FIG. 1) to move piston 212 upward and downward. Piston 212 includes an air piston seal 220 and a liquid piston seal 310. Piston 212 also includes a sealing member 312. In addition, piston 212 includes an aperture that is located between liquid piston seal 310 in seal 312 and extends to the interior of piston 212. Piston 212 has an outlet passage 316 from aperture 314 to outlet to 216. In addition foam pump 120 includes a biasing member 327 to bias piston 212 in the downward direction.

During operation, as piston 212 moves downward from the position shown in FIG. 2 to the position shown in FIG. 3, liquid flows from the container 116 past one-way liquid inlet valve 208 into liquid pump chamber 306. As air pump chamber 320 expands, air is drawn in through outlet 216 into air pump chamber 320. In addition, venting valve 240 moves from the position shown in FIG. 2A to the position shown in FIG. 3A. When venting valve 240 moves downward, sealing surface 244 moves away from housing 245 and opens a path from air pump chamber 320 to area 250 located below wiper seal 246. As liquid is pumped out of container 116 a vacuum pressure is created in container 116. Once the vacuum pressure in container 116 rises above the cracking pressure of venting valve 240, air from area 250 flows into container 116 to vent the container.

When foam pump 120 moves from the position shown in FIG. 3 upward to the position shown in FIG. 2, liquid in pump chamber 306 flows past liquid outlet piston seal 310 through aperture 314 and down outlet passage 316. Simultaneously, air flows from air pump chamber 320 through passage 321 and into outlet passage 316 where it mixes with the liquid. The liquid and air mixture in outlet passage 316 is forced through screens 317. The turbulence caused by the screens creates a rich foam that is forced out of outlet 216. The pressure in air pump chamber 320 pushes venting valve 240 upward causing sealing surface 244 to engage housing portion 245 and seals the air pump chamber 320 from the interior of container 116 to prevent air from flowing from the air pump chamber 320 into container 116.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A refill unit comprising:
a non-collapsing container;
a foam pump;
the foam pump having a compressible air chamber;
a passage between the interior of the compressible air chamber and the interior of the container; and
a regulating valve regulating flow from the interior of the compressible air chamber to the interior of the container;
wherein pressure in the compressible air chamber causes the regulating valve to prevent air from passing from the interior of the compressible air chamber to the interior of the container.

2. The refill unit of claim 1 wherein the regulating valve includes a wiper seal in fluid communication with the interior of the container.

3. The refill unit of claim 2 wherein vacuum pressure in the container causes regulating valve to allow air to pass from the interior of the compressible air chamber to the interior of the container.

4. The refill unit of claim 1 wherein the regulating valve includes a seal member in fluid communication with the interior of the pump chamber, wherein when the pump chamber is compressed, the seal member seals against a wall of the compressible air chamber and prevents air from passing through the passage.

5. The refill unit of claim 1 wherein the regulating valve moves upward to seal off the interior of the air chamber from the interior of the container when the air chamber is pressurized.

6. The refill unit of claim 1 wherein the regulating valve moves downward when the air chamber is not pressurized.

7. The refill unit of claim 1 wherein the regulating valve includes a first seal for sealing against a wall in the interior of the container and a second seal for sealing against a wall in the interior of the air chamber.

8. The refill unit of claim 1 wherein the regulating valve moves downward due to the weight of a fluid in the container.

9. The refill unit of claim 1 wherein the regulating valve is a unitary part.

10. A refill unit comprising:
a non-collapsing container;
a foam pump;
the foam pump having a compressible air chamber;
a passage between the interior of the compressible air chamber and an interior of the container; and
a movable valve secured to the passage, the movable valve having a first position that prevents pressurized air from flowing from the air chamber into the interior of the container and a second position that allows vacuum pressure in the interior of the container to draw air from the interior of the compressible air chamber to the interior of the container.

11. The refill unit of claim 10 wherein weight of fluid in the container urges the movable valve downward.

12. The refill unit of claim 10 wherein pressure in the compressible air chamber urges the movable valve upward.

13. The refill unit of claim 10 wherein vacuum pressure in the interior of the container causes air to flow from the compressible air chamber to the interior of the container when the movable valve is in a downward position.

14. The refill unit of claim 10 wherein vacuum pressure in the interior of the container does not cause air to flow from the compressible air chamber to the interior of the container when the movable valve is in an upward position.

15. The refill unit of claim 10 wherein the movable valve includes a wiper seal on a first side of the passage and a second seal on a second side of the passage.

16. The refill unit of claim 10 wherein the movable seal is a unitary piece.

17. A refill unit comprising:

a non-collapsing container;

a foam pump;

the foam pump having a compressible air chamber;

a passage between the interior of the compressible air chamber and an interior of the container; and a valve secured to the passage, the valve having a wiper seal located within the interior of the container and a second seal located at least partially within the compressible air chamber.

18. The refill unit of claim 17 wherein the valve moves between a first position that prevents pressurized air from flowing from the interior of the compressible air chamber to the interior of the container and a second position that allows vacuum pressure in the interior of the container to draw air from the compressible air chamber when the compressible air chamber is not pressurized.

19. The refill unit of claim 17 wherein fluid in the container biases the valve in a downward direction.

* * * * *